United States Patent [19]

Boon et al.

[11] 4,181,037

[45] Jan. 1, 1980

[54] LAZY SUSAN ASSEMBLY HAVING AN ADJUSTABLE ALIGNMENT MECHANISM

[75] Inventors: Daniel A. Boon; R. Larry Jones; Naaman Shelton, Jr., all of Louisville, Ky.

[73] Assignee: Jones Plastic & Engineering Corporation, Jeffersontown, Ky.

[21] Appl. No.: 827,231

[22] Filed: Aug. 24, 1977

[51] Int. Cl.[2] ..... G11B 1/00; A47F 3/10; A47B 81/00; F16H 53/06

[52] U.S. Cl. ..... 74/569; 312/11; 312/125; 312/238; 312/305; 108/105

[58] Field of Search ..... 312/11, 125, 197, 305, 312/238, 352, 97.1; 108/103, 104, 105; 74/56, 567, 569

[56] References Cited

U.S. PATENT DOCUMENTS

| | | | |
|---|---|---|---|
| 2,078,612 | 4/1937 | Shisler | 312/125 X |
| 2,698,776 | 1/1955 | Stoeckl | 312/305 UX |
| 2,784,045 | 3/1957 | Ormaetxea et al. | 312/305 X |
| 3,088,787 | 5/1963 | Perkins | 312/305 X |
| 3,110,189 | 11/1963 | Steuer | 74/230.17 F |
| 3,281,197 | 10/1966 | Anderson | 312/305 |
| 3,868,156 | 2/1975 | Van der Ley | 312/238 |

FOREIGN PATENT DOCUMENTS

| | | | |
|---|---|---|---|
| 1429651 | 2/1969 | Fed. Rep. of Germany | 108/103 |
| 2524405 | 12/1976 | Fed. Rep. of Germany | 312/305 |

*Primary Examiner*—Samuel Scott
*Assistant Examiner*—Don E. Ferrell
*Attorney, Agent, or Firm*—Maurice L. Miller, Jr.

[57] ABSTRACT

Rotatable article supporting plates with cabinet doors attached mounted on a rotatable central supporting shaft, the shaft being suspended, at least partially, from a mechanism for adjusting the vertical alignment of the doors relative to the cabinet door frame. The mechanism may be biased to maintain the doors in a preferred rotational position, e.g a closed door position relative to the door frame. The preferred rotational position of the mechanism may also be adjusted to rotationally align the doors in their closed door position in the door frame. The mechanism includes a cam gear disposed in a housing which rotates on a sawtooth track in response to the adjustment of a threaded member to raise or lower the shaft and doors.

12 Claims, 15 Drawing Figures

Fig. 1
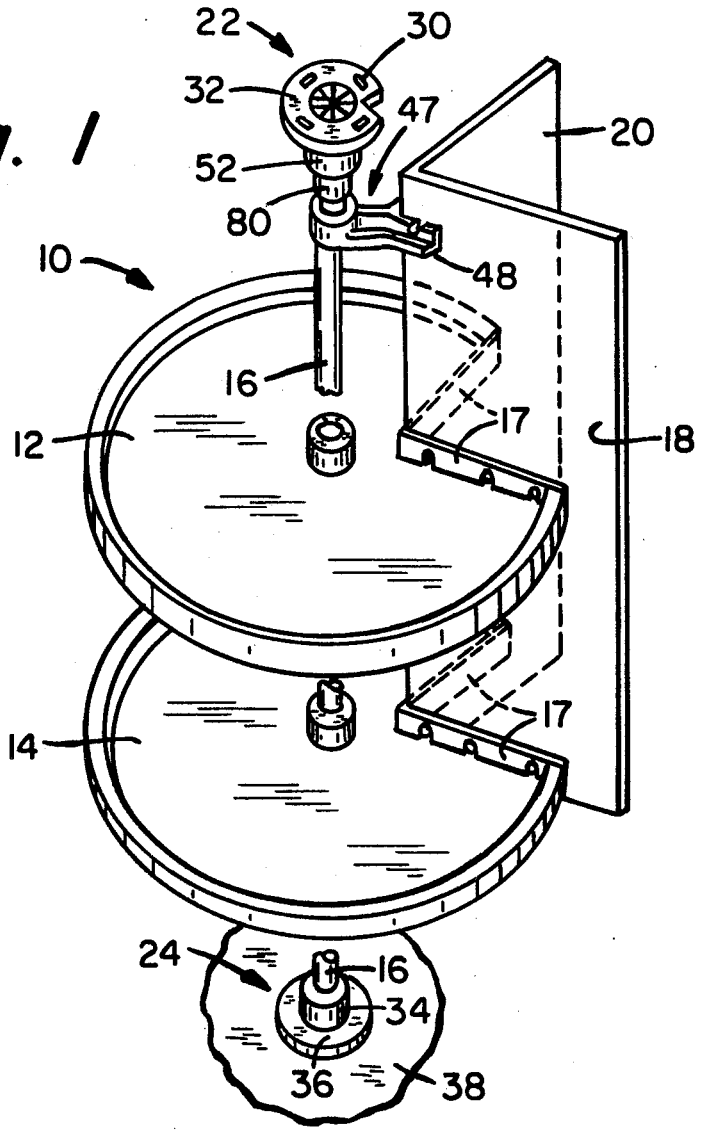
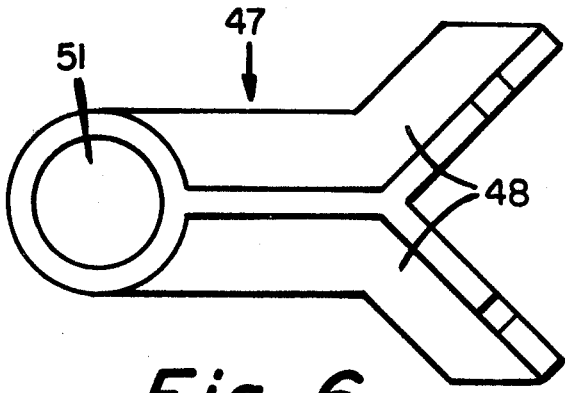
Fig. 6

Fig. 4
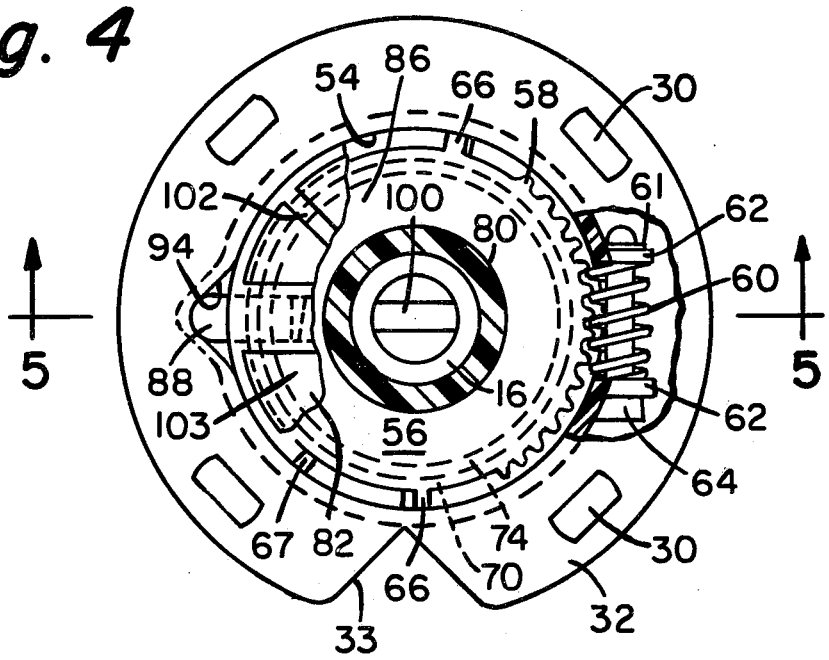
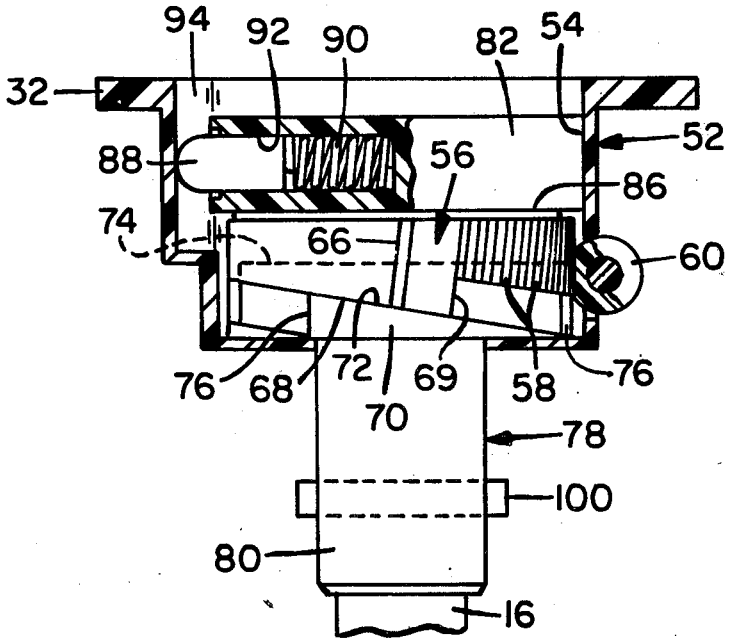
Fig. 5

LAZY SUSAN ASSEMBLY HAVING AN ADJUSTABLE ALIGNMENT MECHANISM

BACKGROUND OF THE INVENTION

This invention relates generally to a rotatable shelf assembly commonly known as a lazy susan and, more particularly, to an adjustable mechanism for aligning the vertical and rotational position of cabinet doors attached to the rotatable assembly, relative to a cabinet door frame.

Lazy Susan shelf assemblies with rotatable doors attached thereto have long been used in the prior art, particularly in corner kitchen cabinets as well as elsewhere. One problem that has been encountered with these prior art assemblies is the difficulty of obtaining and maintaining proper vertical and rotational alignment of the doors relative to the door frame of the cabinet housing the assembly. In the past, it has often been necessary to remove articles stored on the shelves and thereafter remove at least the lower plate from the assembly located near the floor of the cabinet in order to make an adjustment necessary to raise or lower the same into proper alignment with the cabinet and door frame. The problem of vertical alignment of the doors of the assembly often occurs because of long term settling conditions of the house in which the assembly is used, sometimes accelerated by vibration caused by nearby construction, blasting, traffic conditions, and so on.

Another difficulty encountered in the prior art has been the difficulty encountered in securing and maintaining proper rotational alignment of the attached movable doors relative to the cabinet containing the assembly and the door frame. Some lazy susan assemblies are provided with a means for biasing the attached doors to a preferred position, usually a position closed with respect to the door frame. When a rotational misalignment of this closed door position occurs, it has often been necessary in the past to at least partially disassemble the structure in order to effect realignment. This again usually necessitates removing all or most of the numerous articles which may be stored on one or more shelves and removal of one or more shelves.

All such disassembly requirements are troublesome, time consuming, laborious and sometimes more complicated than a housewife should undertake. Our invention substantially overcome these and other prior art difficulties.

SUMMARY OF THE INVENTION

It is an object of our invention to provide a rotatable lazy susan assembly which can be rigidly suspended at its upper end in a cabinet frame.

It is a further object of our invention to provide a rotatable lazy susan assembly which is relatively freely rotatable between one or more stable rest positions.

It is yet another object of our invention to provide a lazy susan assembly which is relatively freely rotatable between one or more stable rest positions, which rest positions can be readily adjusted to alter the alignment thereof relative to a supporting frame.

It is also an object of our invention to provide a rotatable lazy susan assembly having one or more stable rest positions which can be adjusted to alter the rotational alignment thereof relative to a cabinet frame.

It is an additional object of our invention to provide a lazy susan assembly with one or more attached doors which is adjustable to effect height alignment of such doors relative to a cabinet door frame.

It is another object of our invention to provide an adjustable alignment mechanism for a lazy susan assembly.

Briefly, in accordance with our invention, there is provided an improved rotatable lazy susan assembly of the type which includes a rotatable supporting shaft, at lease one article supporting plate connected to the shaft for movement therewith, and door means attached to the plate for movement therewith. The improvement comprises means connectable to the frame containing the assembly for at least partially suspending the assembly therefrom and for adjusting the alignment of the assembly relative to the frame.

These and other objects of our invention will become apparent to those skilled in the art from the following detailed description and attached drawings upon which, by way of example, only the preferred embodiments of our invention are illustrated.

BRIEF DESCRIPTION OF THE DRAWINGS

FIG. 1 shows an oblique projection of a lazy susan assembly including an adjustable alignment mechanism, illustrating one preferred embodiment of the subject invention.

FIG. 4 shows a top plan view of the mechanism of FIGS. 1–3 illustrating an intermediate position of door height alignment thereof.

FIG. **5*a* shows an elevation view of the mechanism of FIGS. 1–5 as viewed 90 degrees in horizontal rotational displacement from the mechanism as viewed in FIG. 4**.

Figure 2:
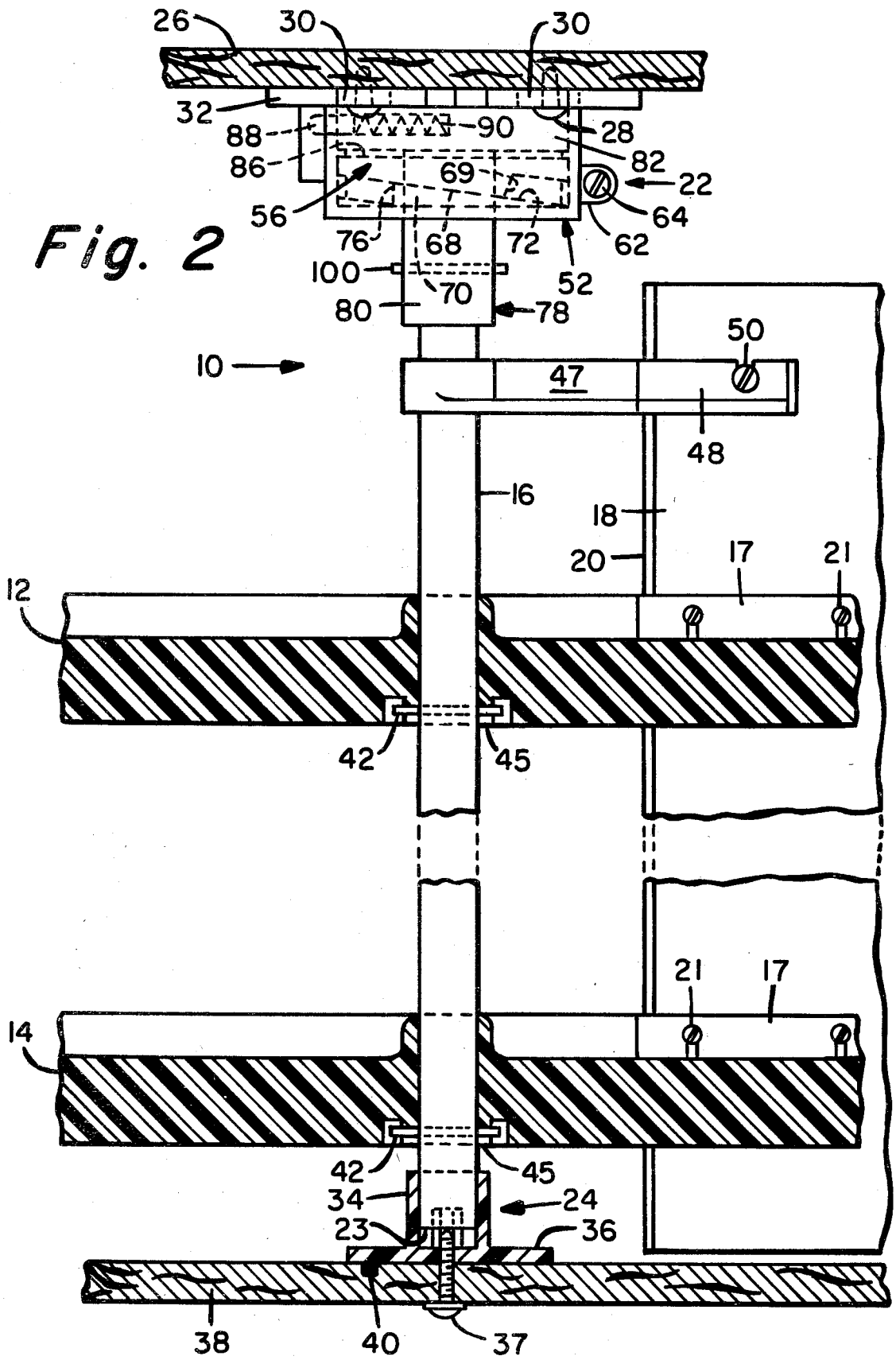
FIG. 2 shows a cross-sectional elevation view of the assembly of FIG. 1.

FIG. 6 shows a top plan view of a Y-shaped door brace as seen from different perspective in FIGS. 1–2.

Figure 3:
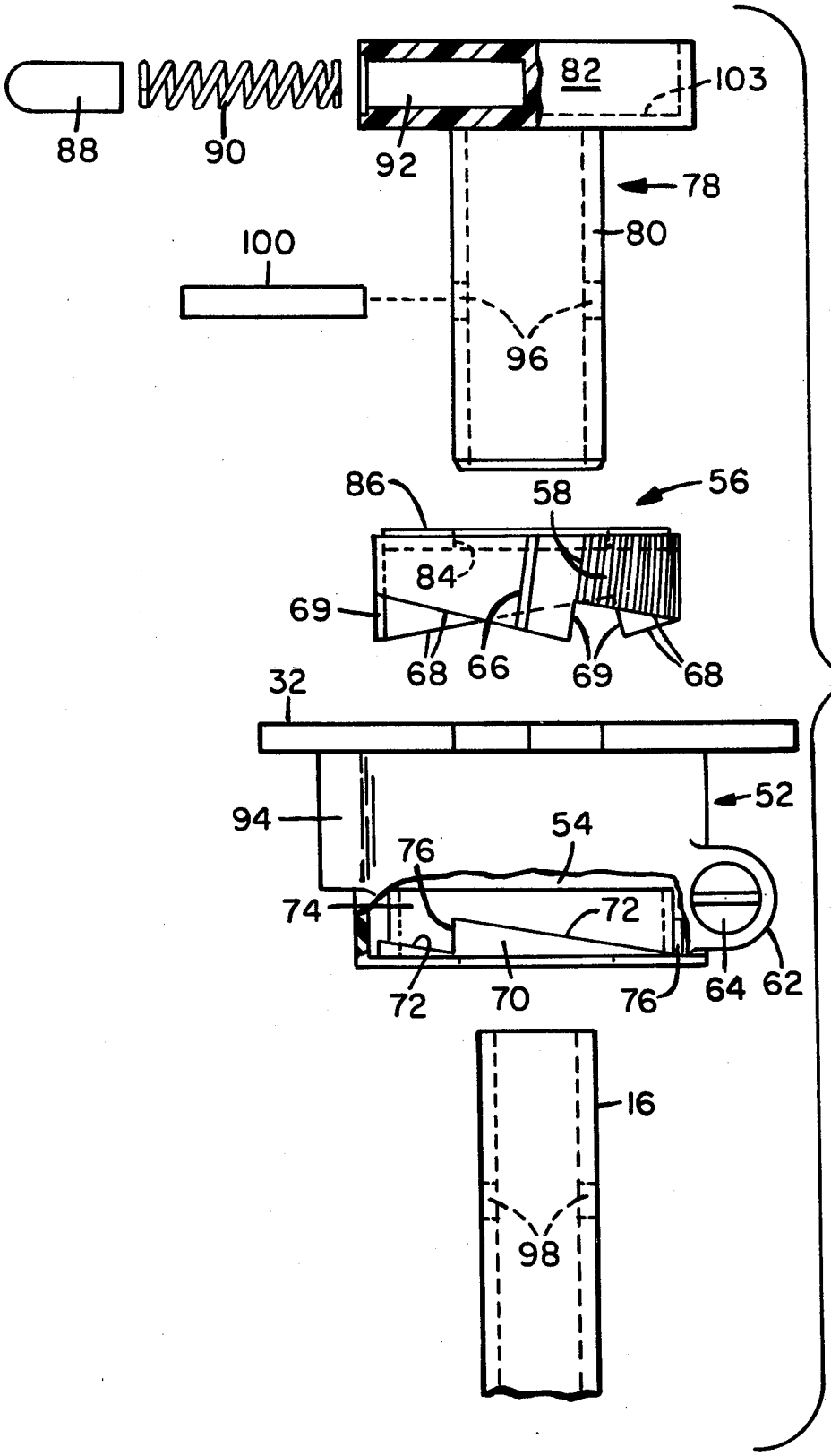
FIG. 3 shows an exploded elevation view of the various component parts of the mechanism of FIGS. 1–2.
Figure 7:
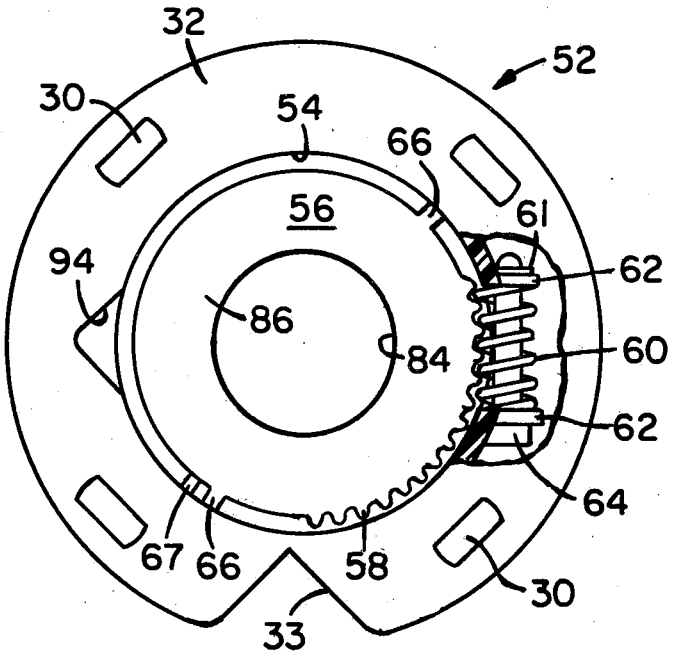
Figure 8:
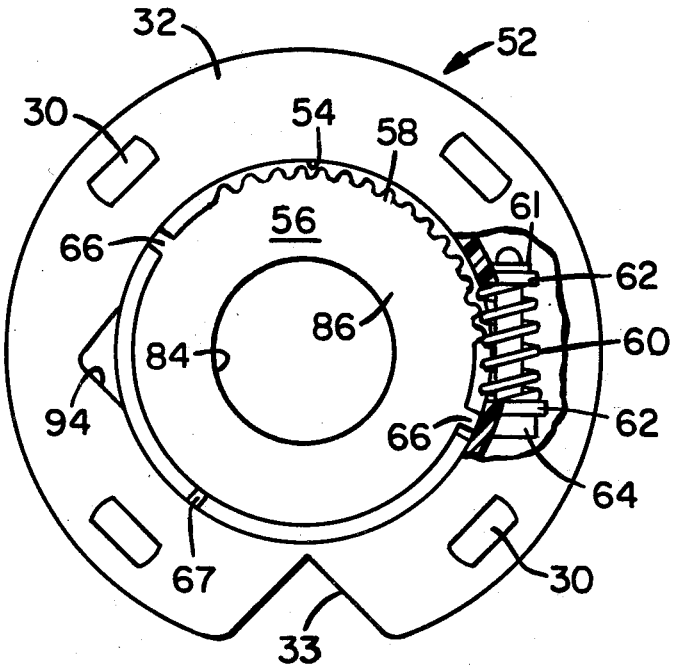

FIGS. 7–8 show top plan views of the mechanism of FIGS. 1–3 illustrating extreme clockwise and counterclockwise positions of door height adjustment, respectively.

Figure 9:
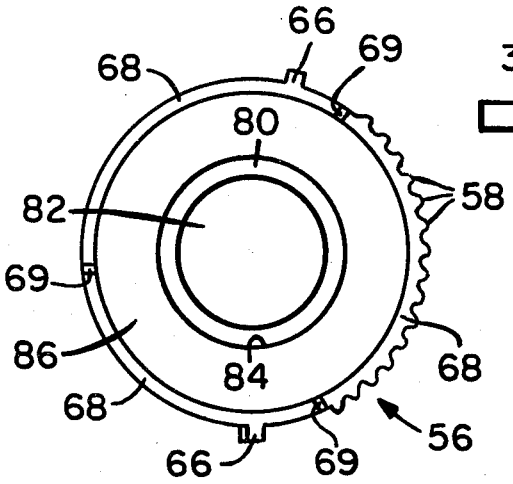

FIG. 9 shows a bottom plan view of a circular cam gear, one of the component parts of the mechanism as also shown in FIGS. 2–5 and 7–8 from different perspectives.

Figure 10:
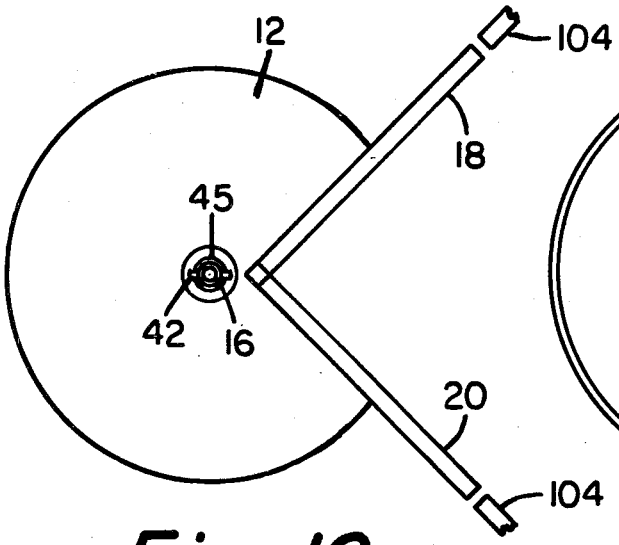

FIG. 10 shows a bottom plan view of a lazy susan article supporting plate with doors attached as shown in FIGS. 1–2 from different perspectives.

FIG. **10*a* shows a bottom plan view of an enlarged central segment of the plate of FIG. 10** illustrating plate supporting means.

Figure 11:
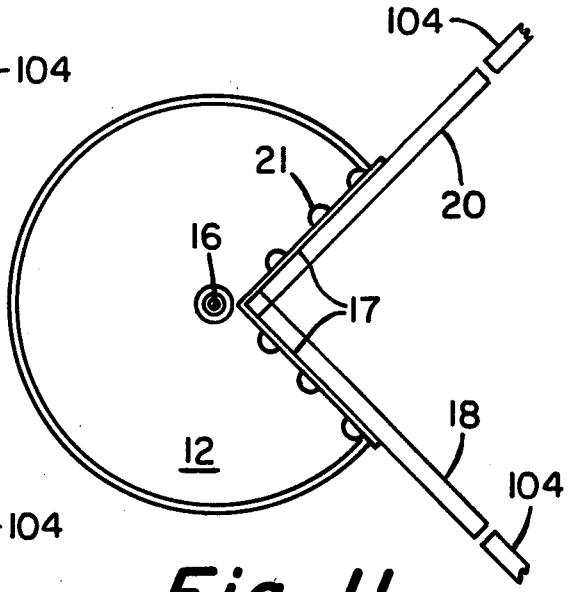

FIG. 11 shows a top plan view of the plate and doors of FIG. 10.

Figure 12:
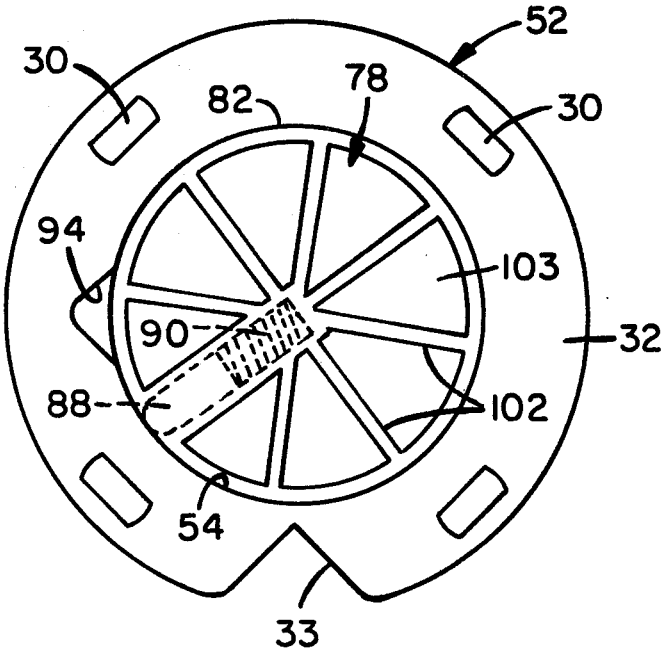

FIG. 12 shows a top plan view of the mechanism of FIGS. 1–3 illustrating an unlocked door rotating condition thereof.

Figure 13:
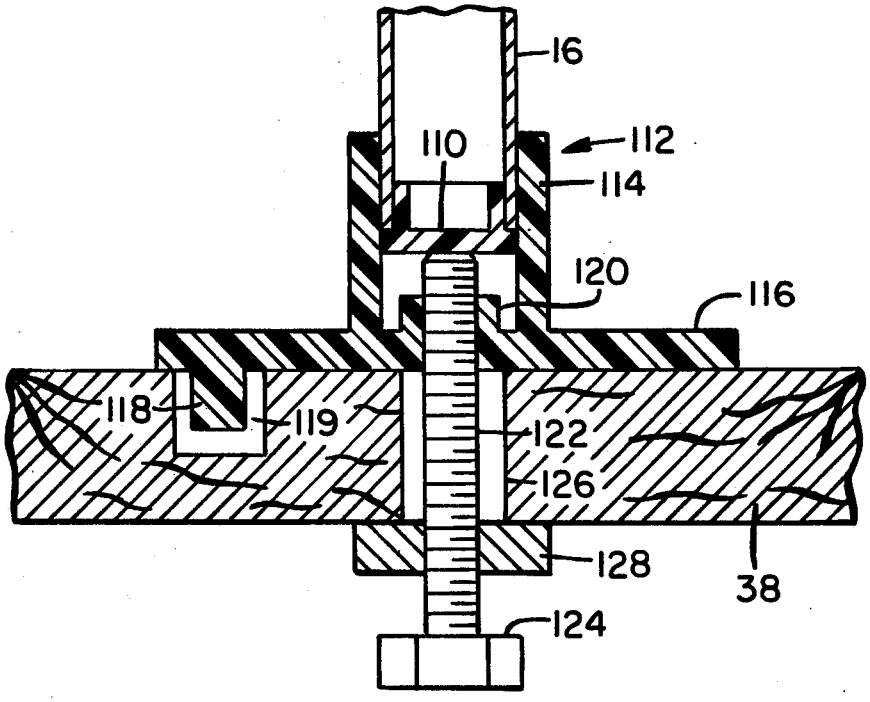

FIG. 13 shows a cross-sectional elevation view of an optional weight supporting base guide which may be used in place of the base guide illustrated in the assembly of FIG. 2.

DESCRIPTION OF THE PREFERRED EMBODIMENT

Referring to the figures, there is shown, in one preferred embodiment of our invention, a rotatable shelf assembly or lazy susan 10 adapted for mounting within a suitable supporting frame such as a corner kitchen cabinet, for example. Included is a pair of article supporting plates 12, 14 spaced apart and fixedly attached to a rotatable central supporting shaft 16. The plates 12, 14 may be constructed of any suitable material such as wood, metal or plastic and define right angular wedge shaped recesses, the defining walls 17 of which support a pair of cabinet doors 18, 20 attached thereto by means of suitable fasteners 21. The supporting shaft 16 should be constructed of a material suitable for supporting the weight of the plates 12, 14 when fully loaded to their design limits so as not to deflect or bend, particularly when rotated, such as a suitable gauge steel.

The upper end of the shaft 16 is connected to and suspended from an adjustable door alignment mechanism 22 while the lower end 23 is inserted into a base guide member 24. The mechanism 22 is securely fastened to a top frame member 26 of the cabinet by means of suitable fasteners 28 inserted through a series of elongated slots 30 disposed about the periphery of a top flange 32. The guide member 24 may be constructed of any suitable material such as wood, metal or plastic and includes a hollow neck 34 adapted to receive the lower end 23 of shaft 16 therein in relatively tight fitting but rotatable relationship, and a supporting base 36. A threaded fastener 37 secures the member 24 to a floor 38 of the cabinet so as to maintain the shaft 16 in proper vertical alignment. Where self-tapping of the member 24 by the fastener 37 is employed, a cylindrically shaped downward projecting locking key 40 may be formed on the base 36 and inserted into a hole drilled in the floor 38 to restrain the member 24 from rotating as the self-tapping fastener 37 is inserted and threaded into the base 36. Note that the lower end 23 of shaft 16 floats free within the neck 34 and is spaced above the base 36 such that the remainder of the assembly 10 is suspended from the cabinet ceiling 26. An alternative base guide structure for use with the lazy susan of our invention is shown in FIG. 13 and will hereinafter be explained in detail.

Figure 10A:
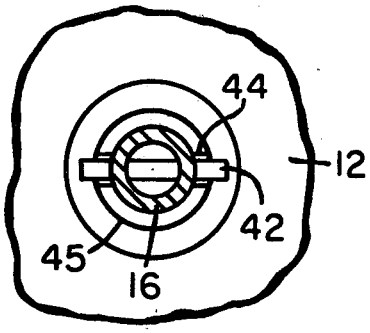

Referring now particularly to FIGS. 2, 10 and 10*a*, it will be seen that the plates 12, 14 are fixedly connected to the shaft 16 so as to rotate in unison therewith by means of pins 42 which project through and beyond opposite sides of the shaft 16 and lie within downward opening slots 44 formed in a hollow cylindrical shoulder 45 recessed in the bottom of said plates. As a result, the plates 12, 14 simply rest upon the pins 42 due to their weight. The pins 42, being recessed within the bottom surface of the plates 12, 14 can not work themselves free of the shaft 16 to cause the plates to fall, a result which might otherwise occur over a period of extended usage were the pins to project through either side of the shaft 16 through confining brackets projecting below the bottom of each saide plate.

The doors 18, 20 are attached to the right angular wedge defining walls 17 by means of suitable fasteners 21. Additional support or bracing for the doors 18, 20 is provided by a Y-shaped brace 47 (FIGS. 1, 2 and 6) which may be constructed of any suitable material such as wood, metal or plastic. A pair of right angular legs 48 of the brace 47 lie flush against the backs of the doors 18, 20 near the upper end thereof and are fixedly connected thereto by means of suitable fasteners 50 (FIG. 2). The base of the brace 47 defines a hole 51 for insertion of the shaft 16 therethrough to allow the brace 47 to be disposed just below the mechanism 22 to permit clearance above articles rotating on the plate 12.

The alignment mechanism 22 includes a housing 52 having a hollow interior or cavity opening through the flanged shoulder 32 and defined by a generally cylindrical shaped interior wall 54. A circular cam gear 56 is disposed within the housing 52 and contains a plurality of pitched teeth 58 projecting outward from the side thereof and extending around a portion of the periphery. The teeth 58 engage an adjustable threaded screw 60 confined between a pair of support brackets 62 formed or adjoined on the exterior wall of the housing 52. An opening or window is provided in the housing sidewall such that at least a central portion of the screw threads 60 project into the interior cavity of the housing 52 beyond the interior wall 54 to engage and interleave with the teeth 58. The screw 60 is preferably provided with a relatively large screw head 64 for ease of adjustment with a coin, butter knife, screw driver or other suitable instrument which might readily be found in a kitchen. A simple snap ring 61 confines the screw 60 in place.

Figure 5A:
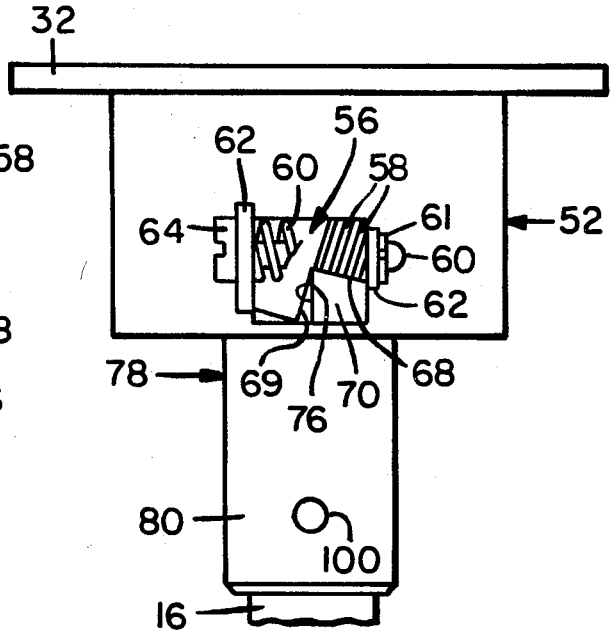
FIG. 5 shows a fragmented elevation view of the mechanism of FIG. 4 in the same intermediate position of adjustment.

A pair of raised elongated ribs or stops 66 are formed on the side of the gear 56 beyond opposite ends of the teeth 58. As shown in FIG. 7, one of the stops 66 contacts a raised elongated rib or stop 67 projecting from the interior wall 54 to limit clockwise rotation of the gear 56 to prevent the teeth 58 from becoming disengaged from the screw threads 60. The gear 56 includes a sawtooth like circular base forming a series of three inclines 68, each of which inclines rises in a linear manner from a low point to a high point while extending in a circular arc of approximately 120 degrees. The gear 56 is disposed in the cylindrical cavity of the housing 52 such that the inclines 68 slidably engage a raised circular track 70 formed on the base of the housing defining three incline conforming ramps 72. The ramps 72 rise in a linear manner from a low point on the base of the housing 52 to a high point approximately 120 degrees around the track 70, the slopes of which conform to the slopes of the inclines 68. As shown in FIGS. 5*a* and 8, the incline separating walls 69 of the gear 56 engage the ramp separating walls 76 of the track 70 to limit counterclockwise rotation (relative to FIG. 8) of the gear 56 so that the teeth 58 do not become disengaged from the screw threads 60. Thus, with reference to FIG. 7, clockwise rotation of the gear 56 is limited by the interference of the stops 66, 67, while the reference to FIGS. 5*a* and 8, counterclockwise rotation of the gear 56 is limited by interference of the walls 69, 76. Note that the teeth 58 extend around the side of the gear 56 within a 120 degree arc over one of the three inclines 68.

A third principal element of the mechanism 22 is a flange shaped rotatable member 78 having a hollow tubular shank 80 projecting downward from a flanged or disc shaped cap 82. The shank 80 projects downward through a central hole 84 formed in a flat upper surface 86 of the gear 56 so that the base of the cap 82 rests flush upon the surface 86. A bullet shaped member 88, which may be formed of plastic, is compressed against a spring 90 and inserted into a hollow cylindrical shaft 92 formed in the side of the cap 82. The gear 56 and member 78 is thereafter inserted into the interior cavity of the housing 52 with the bullet 88 partially compressed into the shaft 92 and aligned to slide downward into a wedge shaped recess 94 formed in the wall 54. The shank 80 projects downward through a central hole in the floor of the housing 52 so that holes 96 therein register with holes 98 in an upper end portion of the shaft 16. A pin 100 is inserted through the holes 96, 98 to fixedly connect the member 78 to the shaft 16 for rotation in unison therewith. The shaft 16 is therefore rotatably suspended from the mechanism 22.

The housing 52, gear 56 and member 78 may be constructed of molded plastic or other suitable material. The cap 82 may contain a series of radially projecting ribs 102 to enhance its strength while minimizing the amount of material used to form the same.

Referring particularly to FIGS. 4–5, it will be seen that the bullet 88 projecting into the recess 94 tends to maintain the member 78 in a single preferred rotational alignment relative to the housing 52. Consequently, the shaft 16 attached to the member 78 tends to remain the same preferred rotational alignment. This stable preferred position is the closed door position of the assembly 10. When installing the assembly 10 in a cabinet frame at the point of manufacture, the mechanism 22 should be aligned horizontally through the rear of the frame so that the doors 18, 20 are satisfactorily aligned in a closed position while the bullet 88 projects within the recess 94. The flanged shoulder 32 of the housing may then be firmly secured to the ceiling 26 of the frame by tightening the screws 26 in a central region of the elongated slots 30.

After such installation of the assembly 10, as the doors 18, 20 are rotated away from the closed position in the door frame 104, the bullet 88 will compress further within the hole 92 as it slides along the tapered walls of the recess 94 until it is completely compressed by the cylindrical wall 54. The outer end of the bullet 88 thereafter bears relatively forcefully against the cylindrical wall 54 as the cap 82 and attached rotatable assembly turns horizontally through nearly 360 degrees until the bullet 88 returns to engagement with the recess 94 once again. During the portion of rotation wherein the bullet 88 is fully compressed by the wall 54, the rotation of the assembly is relatively smooth and free of rotation opposing friction. However, once the bullet 88 rotates to return engagement with the recess 94, the assembly tends to lock, thus ceasing rotation whereby the doors 18, 20 are returned to their stable closed door position in the door frame 104.

It should be observed that additional wedge shaped recesses similar to the recesses 94 could be formed at other angular positions around the wall 54 to cause the doors 18, 20 to stop and lock in other stable rotational positions. For example, the doors 18, 20 could be stopped and locked at quarter turn positions if desired by forming three additional wedge shaped recesses 45 degrees displaced from one another around the wall 54.

Over a period of extended usage, the vertically suspended lazy susan assembly 10 may sag due to heavy and unevenly distributed weight supported by the plates 12, 14. Aging of the cabinet frame, settling of the house, vibration caused by nearby traffic or blasting and drilling associated with nearby construction are a few additional reasons why such sag may occur. In any event, the sag may become manifest by a noticeable vertical misalignment of the doors 18, 20 in the door frame 104 possibly accompanied by binding or catching of the doors 18, 20 against the floor 38. By adjusting the screw 60, the gear 56 can be rotated so that the latter slides upward along the ramps 72 to raise the member 78 and attached shaft 16, plates 12, 14 and doors 18, 20. The mechanical advantage that can be obtained by selecting a suitable gear ratio between the screw 60 and gear 56 allows the housewife to make this upward adjustment of the doors 18, 20 easily even with articles of significant weight bearing upon the plates 12, 14. Moreover, because the mechanism 22 is located at the top of the assembly 10, such adjustment does not require disassembly of the structure or removal of one or more of the plates 12, 14 or articles being supported thereby in order to gain access to it.

A horizontal misalignment of the doors 18, 20 relative to their door frames 104 can also be corrected by our invention. The doors 18, 20 are simply rotated to the rear of the frame to a fully open position, whereafter the screws 28 are loosened so that the mechanism 22 can be lifted and rotated slightly by hand due to the elongated slots 30. Since the slots 30 are disposed in a circle about the center of rotation of the mechanism 22 on a radius substantially less than the radius of rotation of the doors 18, 20, a small horizontal rotational adjustment of the housing 52 will produce amplified and correspondingly larger rotational realignment of the closed door position of the recess 94 and doors 18, 20. The doors 18, 20 may then be returned to their closed door position to check the door alignment. This process may be repeated if necessary until a satisfactory alignment is obtained.

Referring now particularly to FIG. 13, an alternative base guide 112 is shown which may be used with the assembly 10 in place of the base guide 24. The guide 112 includes a hollow cylindrical shoulder 114 attached to a flanged base 116. As in the case of the base guide 24 of the previous example, a locking key 118 projects into a hole 119 drilled in the floor 38. A Shoulder 120 is formed on the base 116 within the shoulder 114 to receive a self-tapping screw 122. An end cap 110 is inserted into the bottom end of the shaft 16 and the screw 122 is adjusted until the top end bears against the cap 110. In this manner, should the ceiling 26 tend to sag under the weight of the assembly 10, the screw 122 can be adjusted to provide a sufficient degree of support to eliminate the ceiling sag. A bolt 28 may then be tightened on the threads of the screw 122 against the floor 38. The hole 119 and a shaft 126 through which the screw 122 extends should preferably be large enough to allow for horizontal adjustment of the guide 112 along the floor 38 to obtain accurate vertical alignment of the shaft 16 under the mechanism 22.

It should be noted that the gear 56 could be provided with a tilted circular base adapted to slide upon a similarly tilted track, whereby no sawtooth like ramps or inclines would be required. However, such a modification of the gear 56 and track 70 of the present example would necessitate providing a housing 52 of considerably greater depth than that of the present example in order to permit the raising or lowering of the shaft 16 and doors 18, 20 by the same vertical distance. Similarly, a housing of an intermediate depth could be used if the gear 56 were provided with only two inclines 68, each extending approximately 180 degrees around the base thereof. The use of three inclines 68, each extending approximately 120 degrees around the base of the gear 56 is believed by us to be preferably, but not essential. It should also be recognized that more than three inclines and ramps could be employed in the mechanism of our invention if desired.

Although the subject invention has been described with respect to specific details of certain preferred embodiments thereof, it is not intended that such details limit the scope of our invention except to the extent as set forth in the following claims.

I claim:

1. An adjustable alignment mechanism for a rotatable lazy susan assembly comprising:

a housing defining a cylindrically shaped cavity, a raised annular sawtooth like track formed on a cavity defining floor of said housing, a cylindrically shaped cam gear having a plurality of teeth extending from the side of said gear and having an annular sawtooth like base comforming to said track, said gear being slidably disposed on said track, adjusting threaded means rotatably attached to said housing and operatively engaging said teeth for rotating said gear on said track to raise and lower said gear in said cavity, and a rotatable member fixedly connectable to said assembly for rotational movement in unison therewith, said member being supported by said gear in slidable relation therewith, whereby adjustment of said threaded means produces raising and lowering of said assembly.

2. The mechanism of claim 1 further comprising means for limiting the rotational movement of said gear relative to said housing for prohibiting operative disengagement of said threaded member and teeth, said teeth extending around a portion of said side.

3. The mechanism of claim 1 wherein said base and track define at least two conforming inclines and ramps respectively, said inclines and ramps rising in a linear manner from a low point to a high point while extendings in a circular arc around said base and track respectively, said teeth extending around a portion of said side over a single one of said inclines.

4. The mechanism of claim 1 further comprising means for maintaining said gear on said track.

5. The mechanism of claim 4 wherein said maintaining means comprises a raised cylindrically shaped retaining wall formed on said floor around an inside wall of said tract and extending into said gear base.

6. The mechanism of claim 1 further comprising means for biasing said rotatable member to at least on preferred position of rotational displacement relative to said housing.

7. The mechanism of claim 2 further comprising means for rotationally adjusting said housing to alter said preferred position relative to a frame containing said assembly.

8. The mechanism of claim 7 wherein said adjusting means for said housing comprises a flanged shoulder formed on said housing defining a series of elongated slots therethrough, said series being disposed generally on a circle around said shoulder and adapted to receive fasteners therethrough to fixedly connect said housing to said frame, whereby said housing can be rotationally adjusted relative to said frame to effect a rotational alignment of said preferred position.

9. In an improved rotatable lazy susan assembly of the type comprising a rotatable supporting shaft, at least one article supporting means connected to said shaft for movement therewith, and door means attached to said article supporting means for movement therewith, the improvement of which comprises cam gear means connectable to a frame containing said supporting means and shaft and connected to an upper end of said shaft for at least partially suspending said supporting means and shaft therefrom and for adjusting the vertical alignment of said supporting means and shaft relative to said frame.

10. The improvement of claim 9 further comprising base guide means separate and distinct from said suspending and adjusting means attached to a floor of said frame for receiving a bottom end of said shaft therein in close fitting rotatable relationship for maintaining said shaft plumb.

11. The improvement of claim 10 wherein said base guide means comprises a base, a hollow cylindrically shaped shoulder extending from said base, said shoulder being open at an upper end for receiving a lower end of said shaft therein, and means for rotatably supporting said lower end in said shoulder to at least partially relive the weight of said shaft and supporting means from a ceiling member of said frame.

12. The improvement of claim 11 wherein said means for rotatably supporting said lower end comprises a cap attached to said lower end to seal the same and form a supporting surface, and an adjustable threaded fastener for insertion through a floor of said frame and into said shoulder for engagement with said cap.

* * * * *